United States Patent [19]

Kurisu et al.

[11] Patent Number: 4,467,024

[45] Date of Patent: Aug. 21, 1984

[54] PROCESS FOR THE PRODUCTION OF THERMO-DEVELOPABLE TYPE DIAZO COPYING MATERIAL

[75] Inventors: Norio Kurisu, Numazu; Tsutomu Matsuda, Shizuoka; Hideo Watanabe; Nobuyoshi Watanabe, both of Numazu, all of Japan

[73] Assignee: Ricoh Co., Ltd., Tokyo, Japan

[21] Appl. No.: 445,873

[22] Filed: Dec. 1, 1982

[30] Foreign Application Priority Data

Dec. 8, 1981 [JP] Japan ..... 56-197126

[51] Int. Cl.[3] ..... G03C 1/60; G03C 1/54; G03C 1/58; G03C 1/74

[52] U.S. Cl. ..... 430/166; 430/151; 430/168; 430/169; 430/176; 430/177; 430/179; 430/350

[58] Field of Search ..... 430/151, 162, 160, 159, 430/158, 177, 179, 169, 168, 166, 176, 348, 350; 346/76 L, 135.1

[56] References Cited

U.S. PATENT DOCUMENTS

| | | | |
|---|---|---|---|
| 3,255,011 | 6/1966 | Welch | 430/151 |
| 3,294,534 | 12/1966 | Halperin | 430/151 |
| 3,353,984 | 11/1967 | Landau | 430/159 |
| 3,520,691 | 7/1970 | Scheler et al. | 430/151 |
| 3,642,483 | 2/1972 | Kubo et al. | 430/159 |
| 4,387,150 | 6/1983 | Yabuta et al. | 430/179 |
| 4,400,456 | 8/1983 | Matsuda et al. | 430/159 |

FOREIGN PATENT DOCUMENTS

| | | | |
|---|---|---|---|
| 1447714 | 1/1969 | Fed. Rep. of Germany | 430/151 |
| Ad.83978 | 9/1964 | France | 430/151 |
| 50-50913 | 7/1975 | Japan | 430/151 |
| 1032508 | 6/1966 | United Kingdom | 430/151 |

*Primary Examiner*—Charles L. Bowers

*Attorney, Agent, or Firm*—Flynn, Thiel, Boutell & Tanis

[57] ABSTRACT

A process for the production of a thermo-developable type diazo copying material which comprises the steps of adding a heat fusible color assistant having a melting point of 50° to 150° C. to at least one selected from the group consisting of (a) an aqueous dispersion A containing a diazonium salt and fine particles of a hydrophobic resin consisting of a polymer of vinyl chloride, vinylidene chloride, styrene, acrylic ester, mechacrylic ester or olefin or a copolymer containing at least one member of aforesaid monomers as the constitution unit or a mixture of said polymer with said copolymer and (b) an aqueous solution or dispersion B containing coupler; then applying these aqueous dispersion A and aqueous solution or dispersion B onto a substrate in the order named; and drying same.

7 Claims, No Drawings

PROCESS FOR THE PRODUCTION OF THERMO-DEVELOPABLE TYPE DIAZO COPYING MATERIAL

BACKGROUND OF THE INVENTION (a) Field of the Invention

The present invention relates to a process for the production of a thermo-developable type diazo copying material which comprises combining a diazonium salt, a coupler and a heat fusible color assistant with fine particles of a specified hydrophobic resin; dividing this into two aqueous liquids of diazonium salt-resinous fine particle system and coupler system; and coating them onto a substrate.

(b) Description of the Prior Art

As the processes for the production of thermo-developable type diazo copying materials (or diazo system heat sensitive recording materials) there have hitherto been well known the following ones: a process that comprises coating an aqueous solution or dispersion consisting essentially of a diazonium salt, a coupler and an alkali generating agent such as urea, sodium trichloroacetate or the like on a substrate such as paper, plastic film or the like and drying, (2) a process that comprises using a heat fusible color assistant such as a high fatty acid amide in place of the alkali generating agent in the process disclosed in the preceding (1), (3) a process that comprises using the coupler of the preceding process (2) encapsulated with a hydrophobic substance such as resin, (4) a process that comprises coating and drying an organic solvent dispersion consisting essentially of a diazonium salt (or coupler) and a hydrophobic resin onto a substrate and thereafter coating and drying an organic solvent or aqueous solution or dispersion consisting essentially of a coupler (or diazo compound) further thereon, and the like.

However, the copying material obtained by the process (1), which is required to be developed at a high temperature of 150° to 200° C., must use a highly thermostable diazonium salt that is unfavorable for the formation of a high density image and further is in need of a high temperature and highly accurate heating equipment. The copying material obtained by the process (2), which may be developed at a low temperature unlike that obtained by the process (1), can surely produce a high density image but is defective in that the preservability of the copying material per se (which is referred to as "raw preservability" hereinafter) is inferior. The copying material obtained by the process (3), wherein the coupler is encapsulated with a hydrophobic substance, can surely ameliorate the defect inherent in the copying material obtained by the process (2) but it is difficult to obtain a high density image at a low developing temperature. On the other hand, the process (4) is defective in that the production cost becomes very expensive because, due to the use of an organic solvent, uniform permeation into a paper substrate is prevented so that stable coating is hindered, a special and accurate coating means is needed and further a means for recovering the organic solvent used is needed, and further that there is a possibility of incurring the danger of workers being poisoned by the organic solvent or causing a fire.

SUMMARY OF THE INVENTION

The primary object of the present invention is to provide a process for the production of a thermo-developable type diazo copying material that can produce a high density image readily in spite of the capability of being developed at a low temperature and further is superior in raw preservability.

The secondary object of the present invention is to provide a thermo-developable type diazo copying material that permits stable coating and can be manufactured cheaply.

In other words, the process according to the present invention is characterized by adding a heat fusible color assistant having a melting point of 50° to 150° C. to at least one selected from the group consisting of (a) an aqueous dispersion A containing a diazonium salt and fine particles of a hydrophobic resin consisting of a polymer of vinyl chloride, vinylidene chloride, styrene, acrylic ester, methacrylic ester or olefin or a copolymer containing at least one member of aforesaid monomers as the constitution unit or a mixture of said polymer with said copolymer and (b) an aqueous solution of dispersion B containing a coupler, then applying aqueous dispersion A and aqueous solution or dispersion B onto a substrate in the order named, and drying same.

The present invention has been completed on the basis of the discovery that a copying material free from the deterioration in raw preservability despite of using an aqueous liquid can be obtained by combining a diazonium salt, a coupler and a heat fusible color assistant with fine particles of a specified hydrophobic resin, dividing this into two aqueous liquids of diazonium salt-resinous fine particle system and coupler system; and coating them onto a substrate in the order named.

DETAILED DESCRIPTION OF THE INVENTION

The diazonium salt used in the aqueous dispersion A according to the present invention and the coupler used in the aqueous solution or dispersion B according to the present invention may be those that have usually been used in the field of two-component type diazo copying materials.

In more detail, the diazonium salt includes a double salt consisting of a chloride of diazo compound and a metal halide (for instance, such as zinc chloride, cadmium chloride, tin chloride or the like); a strong acid salt, such as sulfate, tetrafluoroborate, hexafluorophosphate or the like, of diazo compound, said diazo compound including 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-dimethylamino-3-carboxybenzene, 4-diazo-1-toluylmercapto-2,5-diethoxybenzene, 4-diazo-1,4-methoxybenzoylamino-2,5-diethoxybenzene or the like. However, it is needless to say that the diazo compound used in the present invention should not be limited thereto.

As the coupler, there may be enumerated for instance resorcinol, phloroglucinol, 2-methylresorcinol, phenylmethylpyrazolone, 2,5-dimethyl-4-morpholinomethylphenol, 3-hydroxycyanoacetanilide, parasulfoacetanilide, 1-benzoylamino-8-hydroxynaphthalene-3,6-disulfonamide, 2,3-dihydroxynaphthalene, sodium 2,7-dihydroxynaphthalene-3,6-disulfonate, sodium 2,3-dihydroxynaphthalene-6-sulfonate, sodium 2,5-dihydroxynaphthalene-6-sulfonate, sodium 1-hydroxynaphthalene-4-sulfonate, 1-amino-3-hydroxynaphthalene-3,6-disulfonamide, Naphthol AS, Naphthol AS-D, 2-hydroxynaphthalene-3-biguanide, 2-hydroxynaphthoic acid morpholinopropyl amide, 2-hydroxynaphthoic acid ethanol amide, 2-hydroxynaphthoic acid-N-dimethylaminopropylamide hydrochloride, 2,4,2',4'-tetrahydroxydiphenyl, 2,4,2',4'-tetrahydroxydiphenylsulfoxide, 7-hydroxyethyl malonic acid or the like. The amount of said coupler used suitably in the present invention is 0.5–20 parts by weight per part by weight of the diazonium salt.

A specified hydrophobic resin is used in the aqueous liquid A together with the diazonium salt. This specified hydrophobic resin is (a) a polymer of vinyl chloride, vinylidene chloride, styrene, acrylic ester, methacrylic ester or olefin or (b) a copolymer containing at least one member of said monomers or (c) a mixture thereof. Among them, the styrene, acrylic ester, methacrylic ester or olefin system resin having a molecular weight of 2000 or less can also function as the heat fusible color assistant referred to afterwards. Taking the instance of the copolymer, it is preferable to contain at least one member of said monomers in an amount of 60 mole % or more, and the concrete examples may include vinyl chloride-vinyl acetate copolymer, vinyl chloride-acrylic ester copolymer, vinyl chloride-styrene-acrylonitrile copolymer, vinyl chloride-maleic anhydride copolymer, vinyl chloride-vinylidene chloride copolymer, styrene-acrylic ester copolymer, styrene-hydroxyacrylic ester copolymer, styrene-acrylonitrile copolymer, styrene-butadiene copolymer, methacrylic ester (for instance methyl ester)-butadiene copolymer, ethylene-vinyl acetate copolymer or the like but, as a matter of course, should not be limited thereto. The amount of the specified resin used suitably in the present invention is 0.1 to 100 parts by weight, preferably 1 to 50 parts by weight per part by weight of the diazonium salt. Since these resins are insoluble in water, they are used in the form of fine particles pulverized by a usual method. A commercially available emulsion or latex may be used as it stands. Its particle diameter is preferable to be about 10μ or less.

The heat fusible color assistant is a substance insoluble or hard to dissolve in water and is added to at least one selected from the group consisting of (a) the aqueous dispersion A and (b) the aqueous solution or dispersion B, preferably to the aqueous liquid A. This substance acts to promote the coloring (developing) in the manner of being thermally fused and dissolving the coexisting diazonium salt or coupler. Its melting point is in the range of 50° to 150° C. out of consideration for low temperature development. In concrete, said heat fusible color assistant includes high fatty acid amides and aromatic carboxylic acid anilides such as caproic amide, caprylic amide, capric amide, lauric amide, myristic amide, palmitic amide, stearic amide, arachidic amide, behenic amide, palmitoleic amide, oleic amide, eicosenoic amide, erucic amide, elaidic amide, linolic amide, linolenic amide, ricinoleic amide, N-methylpalmitic amide, N-methylstearic amide, N-propylstearic amide, N-butylstearic amide, stearic anilide, N-methylbehenic amide, N-ethylbehenic amide, N-butylbehenic amide, behenic anilide, N-methyloleic amide, linolic anilide, N-ethylcapric amide, N-butyllauric amide, capric-o-methoxyanilide, N-hexylstearic amide, N-octadecylacetamide, N-octadecylbutylamide, N-octadecylpropionamide, N-oleylacetamide, N-oleylbenzamide, N-laurylbutylamide, N-laurylbenzamide, N-behenylacetamide, N-behenylpropionamide, N-behenylbenzamide, N-myristylbenzamide, N-stearylbenzamide, N-stearylacetamide, N-stearylcyclohexylamide, N-stearyl-o-chlorobenzamide, N-palmitylbenzamide, N-palmitylacetamide and the like; high fatty acids or esters thereof such as undecanoic acid, lauric acid, tridecanoic acid, myristic acid, pentadecanoic acid, palmitic acid, margaric acid, stearic acid, nonadecanoic acid, arachic acid, behenic acid, lignoceric acid, cerotic acid, linderic acid, lauroleic acid, tsuzuic acid, myristoleic acid, zoomaric acid, petroselinic acid, oleic acid, elaidic acid, linolic acid, eleostearic acid, linolenic acid, parinaric acid and their esters; and polyalkylene glycols or their oxides or their copolymers such as polyethylene glycol, polypropylene glycol, polyethylene oxide, polypropylene oxide, polyethylene oxide-polypropylene oxide block copolymer, polyethylene oxide-polypropylene oxide graft copolymer and the like. In case of solid color assistants, they are normally used in the form of fine particles having a particle diameter of 0.1 to 10μ. The amount of the color assistant used suitably in the present invention is 0.1 to 100 parts by weight, preferably 1 to 50 parts by weight per part by weight of the diazonium salt.

The present invention permits the addition of all sorts of additives, that have been used in normal thermo-developable type diazo copying materials, in addition to the abovementioned materials in the aqueous liquid A and/or aqueous liquid B. Such additives include for instance alkali generating agents as well as antioxidants such as urea, thiourea and their derivatives, alkali metal salt of trichloroacetic acid, ammonium chloride, ammonium sulfate, guanidine sulfate, ammonium citrate, sodium benzoate, imidazole and derivatives thereof; preservability improvers such as sodium naphthalenemonosulfonate, sodium naphthalenedisulfonate, sodium naphthalenetrisulfonate, sulfosalicyclic acid, cadmium sulfate, magnesium sulfate, cadmium chloride, zinc chloride and the like; solubilizers such as caffeine, theophyline and the like; acid stabilizers such as citric acid, tartaric acid, sulfuric acid, oxalic acid, phosphoric acid, pyrophosphoric acid and the like; binders such as starch, casein, polyvinyl acetate, polyvinyl alcohol and the like; and image density improvers such as inorganic or organic fine particles of silica, starch, clay, resin and the like. In addition, saponin can be added thereto in a small amount.

The process according to the present invention permits the employment of usual coating means such as wire bar, roll coater and the like in every coating step, but the suitable adhesion amount of a film layer formed after the first drying step as well as a film layer formed after the next drying step is about 0.2 to 15 g/m$^2$.

There are two methods to form an image on the thermo-developable type copying material prepared according to the present invention. The one method comprises subjecting this thermo-developable type diazo copying material to imagewise exposure using a fluorescent lamp or a mercury lamp and thereafter heating it to a temperature of about 50° to 150° C. using infrared ray, heat roller, high-frequency or the like as in the conventional diazo copying material, and the other method comprises heating said thermo-developable type diazo copying material imagewise to the above mentioned temperature by means of a thermal pen, thermal head or the like or comprises subjecting said thermo-developable type diazo copying material to imagewise exposure as well as heat treatment using infrared ray as in the conventional heat-sensitive recording materials. In either method, this thermo-developable type diazo copying material may thereafter be exposed to overall radiation of light from a fluorescent lamp or a mercury lamp for the purpose of decomposing the diazonium salt remaining unreacted in the non-image area and fixing as in the conventional diazo copying materials.

Examples of the present invention will be given hereinafter.

EXAMPLES

EXAMPLE 1

| | |
|---|---|
| 4-diazo-2,5-dibutoxyphenylmorpholine chloride.$\frac{1}{2}ZnCl_2$ | 1.5 g |
| 45% emulsion of styrene - hydroxyethylmethacrylate having a particle diameter of 1μ | 2.0 g |
| Stearic acid amide | 1.0 g |
| Water | 100 ml |

A composition having the above prescription was dispersed by means of a homogenizer. The resulting dispersion was applied onto the surface of a diazo copying base paper by means of a wire bar and dried at 120° C. to thereby form a diazonium salt—resinous fine particle system first layer having an adhesion amount of 3 g/m$^2$. Next, a composition having the following prescription was dispersed by means of a homogenizer:

| | |
|---|---|
| Naphthol AS | 3 g |
| 10% aqueous polyvinyl alcohol solution | 20 g |
| Silica fine particles (particle diameter: 1 to 5μ) | 3 g |
| Water | 100 ml |

The resulting dispersion was applied onto said first layer by means of a wire bar and dried at 120° C. to thereby form a coupler system second layer having an adhesion amount of 1.5 g/m$^2$. Thus, there was prepared a thermo-developable type diazo copying material.

For comparison's sake, on the other hand, there was prepared a thermo-developable type diazo copying material (Control 1) by repeating the exactly same procedure as aforesaid except that the sequence of forming the first layer and the second layer was reversed. Further, a thermo-developable diazo copying material (Control 2) was prepared by repeating the exactly same procedure except that the 45% emulsion of styrene-hydroxyethylmethacrylate copolymer in the first layer-forming aqueous dispersion was replaced by 45% emulsion of polyacrylamide. Still further, a thermo-developable diazo copying material (Control 3) by repeating the exactly same procedure except that the 45% emulsion of styrene-hydroxyethylmethacrylate copolymer was removed from the first layer-forming aqueous dispersion.

Next, an original was placed on each copying material. The same was exposed to ultraviolet ray and then heated at 110° C. for 3 seconds by means of an infrared heater, thereby resulting in the formation of a blue image. Its image density was measured. In order to test the raw preservability, furthermore, each copying material was left standing for 24 hours in a desicator (50° C., 50% RH) for forced deterioration. Thereafter, each copying material was taken out thereof and was further subjected to overall radiation by means of a fluorescent lamp to decompose the diazonium salt in the first layer completely. The background density was measured with each copying material thus treated, and was compared with the background density of each copying material treated according to the same procedure except that the forced deterioration was omitted. The image density and background density were evaluated by means of a Macbeth densitometer. The obtained results are as shown in Table-1.

TABLE 1

| | Image density (110° C. - 3 seconds) | Raw preservability (50° C. - 50% RH - 24 hours) Background density before forced-deterioration | Background density after forced-deterioration |
|---|---|---|---|
| Example 1 | 1.27 | 0.11 | 0.19 |
| Comparative Example 1 | 1.18 | 0.18 | 0.56 |
| Comparative Example 2 | 1.21 | 0.13 | 0.38 |
| Comparative Example 3 | 1.17 | 0.14 | 0.45 |

It can be clearly seen from this table that the copying material of the present invention is especially superior in raw preservability to the control ones.

EXAMPLE 2

| | |
|---|---|
| 4-diazo-1-toluylmercapto-2,5-diethoxybenzene-tetrafluoroborate | 2.0 g |
| 40% emulsion of vinyl chloride - vinyl acetate copolymer having a particle diameter of 0.1μ | 40 g |
| Behenic acid amide | 10 g |
| Water | 100 ml |

A composition having the above prescription was dispersed by means of a homogenizer. The resulting dispersion was applied on the surface of a diazo copying base paper by means of a wire bar and dried at 120° C. to thereby form a diazonium salt—resinous fine particle system first layer having an adhesion amount of 4 g/m$^2$. Next, a solution having the undermentioned composition:

| | |
|---|---|
| 2-hydroxy naphthoic morpholinopropylamide | 2 g |
| 5% aqueous solution of hydroxyethyl cellulose | 10 g |
| Urea | 2 g |
| Tartaric acid | 1 g |
| Water | 100 ml |

was applied on said first layer by means of a wire bar and dried at 120° C. to thereby obtain a coupler system second layer having an adhesion amount of 2 g/m$^2$. Thus, there was prepared a thermo-developable diazo copying material.

Next, an original was placed on the thus obtained thermo-developable diazo copying material. The same was exposed to ultraviolet ray and then heated at 100° C. for 5 seconds by means of an infrared heater, thereby resulting in the formation of a high density blue image. The raw preservability of this copying material was observed superior to the same degree as Example 1.

Further, this diazo copying material was brought into contact with a recorder equipped with a thermal pen heated to 110° C. for recording to find that a high density blue image was formed against a yellow background immediately after said contact. Then, this was subjected to overall radiation of light from a fluorescent lamp for 3 seconds to find that the yellow background was turned white and thus fixed completely.

EXAMPLE 3

| | |
|---|---|
| 4-diazo-2,5-diethoxyphenyl-N,N—dimethylaniline chloride.$\frac{1}{2}ZnCl_2$ | 2.0 g |
| 45% emulsion of vinylidene chloride-methylmecthacrylate copolymer having a particle diameter of 2μ | 3.0 g |
| Behenic acid anilide | 1.0 g |
| Water | 100 ml |

A composition having the above prescription was dispersed by means of a homogenizer. The resulting dispersion was coated onto the surface of a diazo copying base paper by means of a wire bar and dried at 120° C. to thereby form a diazonium salt—resinous fine particle system first layer having an adhesion amount of 3.5 g/m$^2$. Next, a composition having the undermentioned prescription was dispersed by means of a homogenizer:

| | |
|---|---|
| Phloroglucinol | 1 g |
| 10% aqueous solution of polyvinyl alcohol | 20 g |
| Behenic acid anilide | 5 g |
| Water | 100 ml |

The resulting dispersion was applied onto said first layer by means of a wire bar and dried at 120° C. to thereby form a coupler system second layer having an adhesion amount of 3 g/m$^2$. Thus, there was prepared a thermo-developable diazo copying material.

Next, an original was placed on the thus obtained thermo-developable diazo copying material. The same was exposed to ultraviolet ray and then heated instantly by means of a xenon flash lamp, thereby resulting in the formation of a high density black image. The raw preservability of this copying material was observed superior to the same degree as Example 1.

I claim:

1. A process for preparing a thermally developable diazo copying material, which comprises: mixing a heat-fusible color assistant having a melting point of from 50° to 150° C. with water, a diazonium salt and fine particles of a water-insoluble hydrophobic resin whereby to form a first aqueous coating dispersion, said hydrophobic resin being a polymer comprising at least 60 mole % of monomer units selected from the group consisting of vinyl chloride, vinylidene chloride, styrene, acrylic esters, methacrylic esters and olefins; applying a first coating of said first aqueous coating dispersion on a substrate and drying said first coating to form a light-sensitive layer comprising said diazonium salt, said heat-fusible color assistant and said hydrophobic resin on said substrate; then applying a second coating of a second aqueous coating dispersion or solution directly on said light-sensitive layer, said second coating being free of said hydrophobic resin and containing an azo dye coupler capable of forming a dye with said diazonium salt when said copying material is heated, and then drying said second coating to form a coupler layer directly on top of said light-sensitive layer.

2. A process according to claim 1 wherein the amount of the color assistant added to said first aqueous coating dispersion is 0.1 to 100 parts by weight per one part by weight of said diazonium salt.

3. A process according to claim 1 wherein said first aqueous coating dispersion contains from 0.1 to 100 parts of said fine particles of hydrophobic resin per one part by weight of said diazonium salt.

4. A process according to claim 1 wherein said coupler layer contains from 0.5 to 20 parts by weight of said azo dye coupler per one part by weight of said diazonium salt.

5. A process according to claim 1 wherein said color assistant is selected from the group consisting of caproic amide, caprylic amide, capric amide, lauric amide, myristic amide, palmitic amide, stearic amide, arachidic amide, behenic amide, palmitoleic amide, oleic amide, eicosenoic amide, erucic amide, elaidic amide, linolic amide, linolenic amide, ricinoleic amide, N-methylpalmitic amide, N-methylstearic amide, N-propylstearic amide, N-butylstearic amide, stearic anilide, N-methylbehenic amide, N-ethylbehenic amide, N-butylbehenic amide, behenic anilide, N-methyloleic amide, linolic anilide, N-ethylcapric amide, N-butyllauric amide, capric-o-methoxyanilide, N-hexylstearic amide, N-octadecylacetamide, N-octadecylbutylamide, N-octadecylpropionamide, N-oleylacetamide, N-oleylbenzamide, N-laurylbutylamide, N-laurylbenzamide, N-behenylacetamide, N-behenylpropionamide, N-behenylbenzamide, N-myristylbenzamide, N-stearylbenzamide, N-stearylacetamide, N-stearylcyclohexylamide, N-stearyl-o-chlorobenzamide, N-palmitylbenzamide, N-palmitylacetamide, undecanoic acid, lauric acid, tridecanoic acid, myristic acid, pentadecanoic acid, palmitic acid, margaric acid, stearic acid, nonadecanoic acid, arachic acid, behenic acid, lignoceric acid, cerotic acid, linderic acid, lauroleic acid, tsuzuic acid, myristoleic acid, zoomaric acid, petroselinic acid, oleic acid, elaidic acid, linolic acid, eleostearic acid, linolenic acid, parinaric acid, esters of said acids, polyethylene glycol, polypropylene glycol, polyethylene oxide, polypropyrene oxide, polyethylene oxide-polypropylene oxide block copolymer, and polyethylene oxide-polypropylene oxide graft copolymer.

6. A thermo-developable copying material prepared by the process of claim 1.

7. A thermally developable diazo-type copying material comprising:

a support;

a first layer on said support, said first layer consisting essentially of a blend of a diazonium compound suitable for use in a two component diazo-type copying material, from 1 to 50 parts by weight, per 1 part by weight of said diazonium compound, of a heat-fusible color assistant having a melting point of from 50° to 150° C. and from 1 to 50 parts by weight, per 1 part by weight of said diazonium compound, of fine particles of a hydrophobic resin, said heat-fusible color assistant being insoluble or sparingly soluble in water and having a particle size in the range of from about 0.1 to about 1μ, said fine particles of water-insoluble hydrophobic resin having a particle size of 10μ or less, said hydrophobic resin being a polymer composed of from 60 to 100 mole % of monomer units selected from the group consisting of vinyl chloride, vinylidene chloride, styrene, acrylic esters, methacrylic esters and olefins, and up to 40 mole % of a different monomer copolymerizable therewith; and a second layer applied directly on top of said first layer and in surface-to surface contact therewith, said second layer containing an azo dye coupler capable of forming a dye with said diazonium compound, said second layer containing from 0.5 to 20 parts by weight of said azo dye coupler, per 1 part by weight of said diazonium compound contained in said first layer, said second layer being free of said hydrophobic resin.

* * * * *